US005804546A

United States Patent [19]

Hall

[11] Patent Number: 5,804,546

[45] Date of Patent: Sep. 8, 1998

[54] CLEANING COMPOSITION

[75] Inventor: Christopher John Hall, Chester, England

[73] Assignee: Cussons (International) Limited, Stockport, England

[21] Appl. No.: 652,370

[22] Filed: May 23, 1996

[30] Foreign Application Priority Data

May 27, 1995 [DE] Germany ..... 9510856.9

[51] Int. Cl.[6] ..... C11D 17/00; C11D 17/08; C11D 7/50; B65D 85/84

[52] U.S. Cl. ..... 510/406; 510/135; 510/140; 510/159; 206/524.1; 206/524.2; 206/524.3

[58] Field of Search ..... 510/135, 140, 510/159, 406; 206/524.1, 524.2, 524.3

[56] References Cited

U.S. PATENT DOCUMENTS 3,708,431 1/1973 Prussin ..... 252/188.3

*Primary Examiner*—Mukund J. Shah
*Assistant Examiner*—Brenda Coleman
*Attorney, Agent, or Firm*—Salter & Michaelson

[57] ABSTRACT

A cleaning composition consists of a surfactant and two components for example an acid and a carbonate or bicarbonate. When the two components are mixed together a gas is generated which acts on the surfactant to create a lather. The composition may be disposed in a package having two containers one for each component.

27 Claims, 1 Drawing Sheet

CLEANING COMPOSITION

This invention relates to a cleaning composition and more particularly, but not exclusively a personal cleaning composition intended for use in a shower.

Although personal cleaning compositions have been particularly developed for showers, such as shower gels, a significantly large number of people apparently prefer to use a conventional bar of soap in the shower rather than a shower gel. It is believed that one factor responsible for resistance to use of shower gels is connected with lather generation. Shower gels are provided in containers or dispensers from which the user must obtain a dose. This finite amount of gel will produce a finite quantity of lather, but in order to produce a lather the user must apply shear to the gel for example by rubbing it on a part of the body. However, the lather so produced is soon washed away by the stream of water from the shower head. Indeed, in some instances the gel can be washed away before the user is able to apply it to a part of the body and create a lather. A bar of soap, on the other hand, provides a continuous supply of lather even if the stream of water from the shower head is directed onto the soap bar.

It is, of course, known that instantaneous lather can be obtained from cleaning compositions stored in aerosol containers. The release of such compositions from an aerosol together with propellant gas creates a foam ready for immediate use. However, aerosol based compositions are expensive and furthermore are in many cases unacceptable because they are difficult to handle under wet conditions and being made of metal are subject to corrosion.

It is an object of the present invention to provide a cleaning composition, preferably a shower gel from which a lather, is or can be, produced instantaneously or in a very short time and which does not involve the use of an aerosol.

According to the invention there is provided an aqueous cleaning composition comprising a surfactant, a first component and a second component, whereby when the first and second components are combined together a gas is generated which acts on the surfactant to create a lather.

In accordance with the invention the first and second components are kept separate until the composition is to be used. At that time portions of the first and second components are mixed together and as a result a gas is produced which mixes with the surfactant to produce a lather substantially instantaneously. Preferably the first and second components are provided in separate containers which for convenience may be combined together as a single unit. In one embodiment of the invention each container is provided with an outlet and the two outlets are disposed side by side so that as the contents of the containers are dispensed through the outlets they mix together to create the required gas for lather formation. The containers may be made of flexible material so that the contents can be dispensed by applying pressure to the containers.

In another embodiment of the invention means are provided for withdrawing portions of the first and second components from each container and mixing the portions together. Such means may comprise a dip tube extending into each container and means such as a suction pump or the like which may be manually operable to extract the components from the containers. In this embodiment outlets from the containers may merge into a single outlet in which the components mix together and gas is generated.

Any suitable materials can be used for producing the gas provided, in the case where the cleansing composition is to be used for personal cleansing, for example as a shower gel, the materials do not affect the skin or have any other harmful effects. For a shower gel the preferred materials comprise an acid, preferably an alpha hydroxy acid, for example citric acid as one component and a carbonate or bicarbonate, for example sodium bicarbonate as the other component, the gas produced from these components being carbon dioxide.

The surfactant can be included with one or the other component or may be kept separate and combined with the mixture of the two components when they are dispensed. Where an acid and a bicarbonate are used as the first and second components the surfactant is preferably included with the bicarbonate. The choice and amount of surfactant is not critical, it is chosen having regard to the intended purpose of the cleaning composition. The term surfactant as used herein includes soap.

The composition of the invention may include other additives such as are usually included in cleaning compositions, for example thickeners, fragrance and the like. These additional ingredients may be included with one or other component as may be found appropriate.

The invention is further illustrated by the following Example and with reference to the accompanying drawing in which.

EXAMPLE

Figure 1:
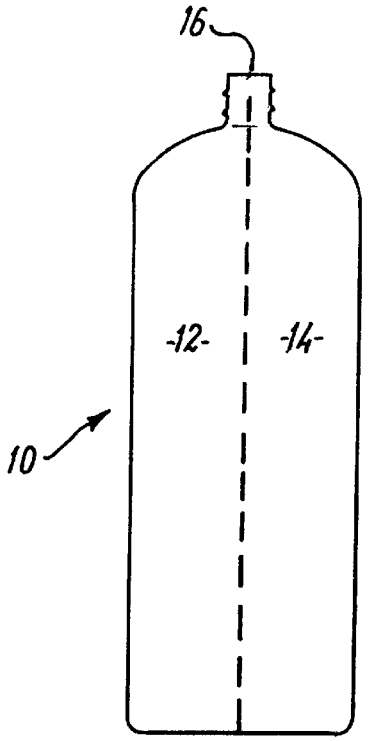
FIG. 1 shows a container in front elevation.

Two components of a shower gel were formulated as follows (all percentages being by weight);

Component 1 (Acid)

30% citric acid

4% Hydroxypropyl guar hydroxypropyltrimonium chloride (thickener)

66% water

Component 2 (Alkali)

5% Sodium bicarbonate 16.8% Sodium lauryl ether sulphate 1.5% Cocamidopropyl betain 1% Aminoxide 3% Coconut diethanolamide 72.7% Water The Components were charged into separate compartments 12, 14, within a flexible container 10 illustrated in the drawing. Each compartment has an outlet leading to a common nozzle 16 which can be closed by a cap not shown. When the container was compressed the contents of both compartments were dispensed through the nozzle. A reaction between the acid and the bicarbonate immediately occurred releasing carbon dioxide gas which in turn created neutral, dense, creamy foam.

The invention is not restricted to the specific embodiment just described nor is it restricted to shower gels. Compositions according to the invention may be used for other cleaning uses including, facial washes, shaving creams, fabric cleaners and hard surface cleaners.

Figure 2:
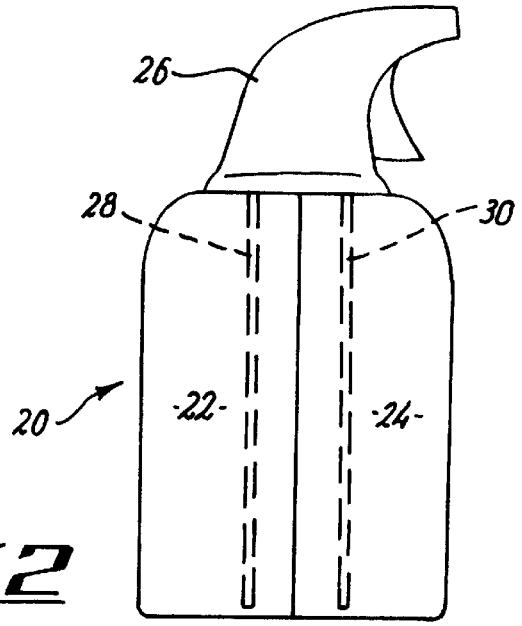
FIGS. 2 and 3 show two further embodiments of containers in diagrammatic side elevation.

Other types of packages can be used with the composition of the invention. For example as shown in FIG. 2 a container 20 having two compartments 22, 24 has a pump action spray 26 mounted on the top thereof with dip tubes 20, 30 extending in to the compartments of the container. This kind of package is known for use in connection with a concentrated substance in one compartment and a diluent in the other whereby the mixture that is dispensed is diluted concentrate.

Figure 3:
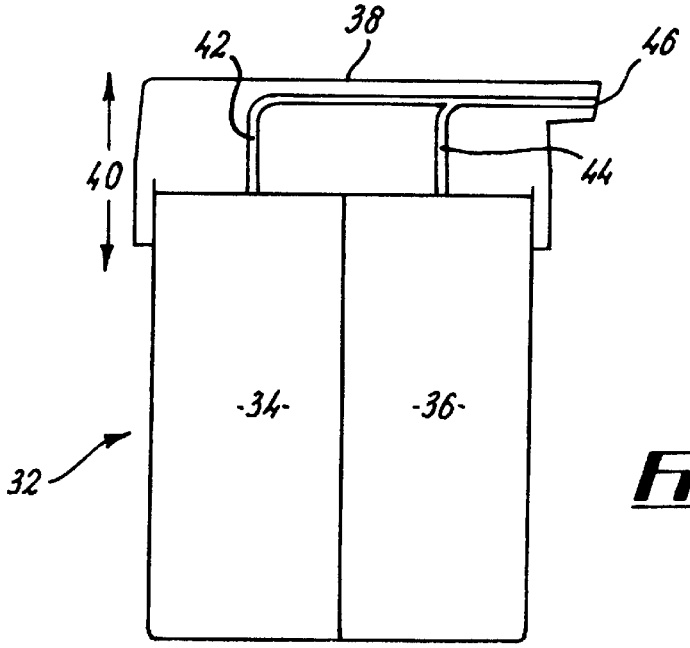

Another type of package that can be used with the composition of the invention is shown in FIG. 3 and comprises a container 32 having two compartments 34, 36. A cap 38 reciprocally movable is indicated by arrows 40 which action pumps the contents of the compartments into outlets 42, 44. The compartment outlets merge together to form a common outlet 46. This type of package is also known but for keeping two ingredients of a cosmetic separate until they are dispensed for use in order to prevent one ingredient which is an emulsion being broken by the other ingredient. Neither of the known packages of FIGS. 2 and 3 have been proposed for use with cleaning compositions.

I claim:

1. An aqueous cleaning composition comprising a surfactant, characterised in that the composition also comprises a first component and a second component whereby when the first and second components are combined together a gas is generated which acts on the surfactant to create a lather.

2. A composition as claimed in claim 1, wherein the first and second components are kept separate from each other until the composition is to be used.

3. A composition as claimed in claim 1, disposed in a package, wherein the first and second components are provided in separate containers.

4. A composition and package as claimed in claim 3, wherein the separate containers for the first and second components are combined into a single unit.

5. A composition and package as claimed in claim 4, wherein each container is provided with an outlet and the two outlets are disposed adjacent each other whereby the contents of the containers dispensed through the outlets will mix together.

6. A composition and package as claimed in claim 3, wherein the containers are made of flexible material so that the contents can be dispensed by applying pressure to the containers.

7. A composition and package as claimed in claim 3, wherein the containers are provided with outlets, said outlets being combined into a single outlet.

8. A composition and package as claimed in claim 3, wherein means is provided for dispensing the contents of the containers.

9. A composition and package as claimed in claim 8, wherein the dispensing means comprises a pump.

10. A composition and package as claimed claim 3, wherein the surfactant is included with one or other of the components.

11. A composition and package as claimed in claim 3, wherein the surfactant is kept separate from the two components until the two components are mixed together.

12. A composition as claimed in claim 1, wherein one component is an acid and the other component is selected from the group consisting of a carbonate and a bicarbonate.

13. A composition as claimed in claim 12, wherein one component is citric acid and the other component is sodium bicarbonate.

14. An aqueous cleaning composition located in a package having first and second containers, the cleaning composition comprising a surfactant, wherein the cleaning composition additionally comprises a first component located in the first container and a second component located in the second container, the surfactant not being pressurized, whereby, when the first and second components are combined together, a gas is generated which acts on the surfactant to create a lather.

15. An aqueous cleaning composition comprising a first component and a second component, at least one of said first and second components including a surfactant, wherein said first and second components react when combined to generate a gas which causes said surfactant to foam.

16. The aqueous cleaning composition of claim 15, wherein said first and second components are isolated from each other until the composition is to be used.

17. The aqueous cleaning composition of claim 15, wherein said first component is an acid and said second component is selected from the group consisting of a carbonate and a bicarbonate.

18. The aqueous cleaning composition of claim 17, wherein said first component comprises citric acid and said second component comprises sodium bicarbonate.

19. The aqueous cleaning composition of claim 15, wherein said gas comprises carbon dioxide.

20. In combination, an aqueous cleaning composition and a container for housing said aqueous cleaning composition, said container comprising first and second compartments and non-aerosol means for dispensing said aqueous cleaning composition, said aqueous cleaning composition comprising a first component disposed in said first compartment and a second component disposed in said second compartment, at least one of said first and second components including a surfactant, said first and second components being composed such that, when said first and second components are dispensed by said dispensing means, said first and second components react with each other to generate a gas which causes said surfactant to foam.

21. The combination of claim 20, wherein said dispensing means comprises means for separately withdrawing said first and second components from said first and second compartments and dispensing said first and second components.

22. The combination of claim 20, wherein said dispensing means comprises means for separately withdrawing said first and second components from said first and second compartments, respectively, combining said first and second components together and dispensing said first and second components.

23. The combination of claim 20, wherein said container is constructed of a flexible material, and said first and second components are dispensed through said dispensing means when pressure is applied to the container.

24. The combination of claim 20, wherein said dispensing means comprises a pump.

25. The combination of claim 20, wherein said first component is an acid and said second component is selected from the group consisting of a carbonate and a bicarbonate.

26. The combination of claim 25, wherein said first component comprises citric acid and said second component comprises sodium bicarbonate.

27. The combination of claim 20, wherein said gas comprises carbon dioxide.

* * * * *

US005804546C1

(12) EX PARTE REEXAMINATION CERTIFICATE (5214th)

United States Patent

Hall

(10) Number: US 5,804,546 C1

(45) Certificate Issued: Oct. 11, 2005

(54) CLEANING COMPOSITION

(75) Inventor: Christopher John Hall, Chester (GB)

(73) Assignee: PZ Cussons (International) Limited, Stockport (GB)

Reexamination Request:
No. 90/006,349, Aug. 8, 2002

Reexamination Certificate for:

| | |
|---|---|
| Patent No.: | **5,804,546** |
| Issued: | **Sep. 8, 1998** |
| Appl. No.: | **08/652,370** |
| Filed: | **May 23, 1996** |

(30) Foreign Application Priority Data

May 27, 1995 (GB) ..... 9510856

(51) Int. Cl.[7] ..... C11D 17/00; C11D 17/04; C11D 17/08; C11D 7/50; B65D 85/84

(52) U.S. Cl. ..... 510/406; 510/135; 510/140; 510/158; 510/159; 510/403; 510/434; 510/435; 206/524.1; 206/524.2; 206/524.3

(58) Field of Search ..... 510/135, 140, 510/159, 406, 434, 435, 403, 158; 206/524.1, 524.2, 524.3; 222/135, 137, 145.6

(56) References Cited

U.S. PATENT DOCUMENTS

| | | | | | |
|---|---|---|---|---|---|
| 1,535,529 | A | | 4/1925 | Hopkins | 222/94 |
| 3,341,418 | A | | 9/1967 | Moses | 222/146.1 |
| 3,488,287 | A | | 1/1970 | Seglin et al. | 424/44 |
| 3,708,431 | A | | 1/1973 | Prussin | 222/146.3 |
| 4,098,435 | A | * | 7/1978 | Weyn | 222/94 |
| 4,211,341 | A | * | 7/1980 | Weyn | 222/94 |
| 4,487,757 | A | * | 12/1984 | Kiozpeoplou | 424/7.1 |
| 5,154,917 | A | * | 10/1992 | Ibrahim et al. | 424/7.1 |
| 5,223,245 | A | * | 6/1993 | Ibrahim et al. | 424/7.1 |
| 5,804,546 | A | | 9/1998 | Hall | 510/406 |
| 6,177,092 | B1 | * | 1/2001 | Lentini et al. | 424/401 |

FOREIGN PATENT DOCUMENTS

| | | | |
|---|---|---|---|
| GB | 2 293 157 | | 3/1996 |
| WO | WO 96/19189 A2 | * | 6/1996 |

OTHER PUBLICATIONS

Morton, Tony; "Module 10 Oral Hygiene Products"; Society of Cosmetic Scientists; first publd 1994.

Morton, Tony, SCS Diploma in Cosmetic Science, Module 10 Oral Hygiene Products, Society of Cosmetic Scientists, 1996, p. 10.

Cutlar, R.A. and Drobeck, H.P., Toxicology of Cationic Surfactants, Cationic Surfactants, Ed. E. Jugermann, Dekker, New York, 1970, Chapter 15, pp. 596 & 599.

Sterzel, Walter, Toxicology of Surfactants Used in Cosmetics, Surfactants in Cosmetics—2nd edition, Ed. M. M. Reiger and L. D. Rhein; Surfactant Science Series, V. 68, TP994.S8763 1997, pp. 561, 562.

* cited by examiner

*Primary Examiner*—Lorna M. Douyon

(57) ABSTRACT

A cleaning composition consists of a surfactant and two components for example an acid and a carbonate or bicarbonate. When the two components are mixed together a gas is generated which acts on the surfactant to create a lather. The composition may be disposed in a package having two containers one for each component.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 10, 15, 16, 19 and 27 are cancelled.

Claims 1, 3, 11, 12, 13, 14, 17, 18, 20 and 25 are determined to be patentable as amended.

Claims 4, 5, 6, 7, 8, 9, 21, 22, 23, 24 and 26, dependent on an amended claim, are determined to be patentable.

New claims 28, 29 and 30 are added and determined to be patentable.

1. An aqueous *gel personal skin* cleaning composition *for external use and package therefor, the composition* comprising [a surfactant, characterised in that the composition also comprises] a first *aqueous alpha hydroxy acid* component and a second *aqueous* component [whereby], *at least one of said first and second components including an effective amount of a personal skin cleaning surfactant and a thickener, wherein the first and second components are kept separate from each other until the composition is to be used and wherein* when the first and second components are combined together [a], *carbon dioxide* gas is generated which acts on the surfactant to create a lather *and wherein as said first and second components are dispensed from the package the two components mix together to create the carbon dioxide gas for lather formation.*

3. A composition *and package* as claimed in claim 1, [disposed in a package,] wherein the first and second components are provided in separate containers.

11. A composition and package as claimed in claim [3] *1*, wherein the surfactant is kept separate from the two components until the two components are mixed together.

12. A composition *and package* as claimed in claim 1, wherein [one component is an acid and] the [other] *second* component is [selected from the group consisting of] a carbonate [and a] *or* bicarbonate.

13. A composition *and package* as claimed in claim [12] *1*, wherein [one] *the first* component is citric acid and the [other] *second* component is sodium bicarbonate.

14. An aqueous *gel personal skin* cleaning composition [located in a package having first and second containers] *for external use and package therefore*, the [cleaning] composition comprising [a surfactant], *a first aqueous alpha hydroxy acid component and a second aqueous component, at least one of said first and second components including an effective amount of a personal skin cleaning surfactant and a thickener*, wherein [the cleaning composition additionally comprises a] *the* first [component located in the first container and a second component located in the second container, the surfactant not being pressurized, whereby] *and second components are kept separate from each other until the composition is to be used and wherein* when the first and second components are combined together, [a] *carbon dioxide* gas is generated which acts on the surfactant to create a [lather] *foam and wherein as said first and second components are dispensed from the package the two components mix together to create the carbon dioxide gas for foam formation.*

17. The aqueous *gel* cleaning composition of claim [15] *14*, wherein [said first component is an acid and] said second component is selected from the group consisting of a carbonate and a bicarbonate.

18. The aqueous *gel* cleaning composition of claim [17] *14*, wherein [said first component comprises citric acid and] said second component comprises sodium bicarbonate.

20. In combination, an aqueous *gel personal skin* cleaning composition *for external use* and a container for housing said [aqueous cleaning] composition, said container comprising first and second compartments and non-aerosol means for dispensing said aqueous *gel personsal skin* cleaning composition, [said aqueous cleaning composition] comprising a first *aqueous alpha hydroxy acid* component disposed in said first compartment and a second *aqueous* component disposed in said second compartment, at least one of said fist and second components including [a] *an effective amount of a personal skin cleaning* surfactant *and a thickener*, said first and second *aqueous* components [being composed such that, when said first and second components] are dispensed by said dispensing means, said first and second components react with each other to generate [a] *carbon dioxide* gas which causes said surfactant to [foam] *lather*.

25. The combination of claim 20, wherein [said first component is an acid and] said second component is selected from the group consisting of a carbonate and a bicarbonate.

*28. An aqueous gel personal skin cleaning composition for external use and package therefor, the composition consisting essentially of a first aqueous alpha hydroxy acid component and a second aqueous component, at least one of said fist and second components including an effective amount of a personal skin cleaning surfactant and a thickener, wherein the first and second components are kept separate from each other until the composition is to be used and wherein when the first and second components are combined together, carbon dioxide gas is generated which acts on the surfactant to create a lather, and wherein as said first and second components are dispensed from the package the two component mix together to create the carbon dioxide gas for lather formation.*

*29. In combination, an aqueous gel personal skin cleaning composition for external use and a container for housing said composition, said container comprising first and second compartments and non-aerosol means for dispensing said composition consisting essentially of a first aqueous alpha hydroxy acid component disposed in said first compartment and a second aqueous component disposed in said second compartment, at least one of said fist and second*

*components including an effective amount of a personal skin cleaning surfactant and a thickener, said first and second aqueous components are dispensed by said dispensing means, said first and second components react with each other to generate carbon dioxide gas which causes said surfactant to lather.*

*30. A gel composition effective for use on skin and a flexible container therefore, the composition consisting essentially of a first aqueous alpha hydroxy acid component and a second aqueous component, at least one of said first and second components including an effective amount of a personal skin cleaning surfactant and a thickener, wherein the first component is contained in a first chamber of the flexible container and the second component is contained in a second chamber of the flexible container, such that upon application of pressure to the flexible container, the first and second components react to generate carbon dioxide gas, the carbon dioxide gas acting on the surfactant to generate a lather.*

* * * * *